United States Patent [19]

McRoy

[11] 4,171,837

[45] Oct. 23, 1979

[54] BURGLARY RESISTANT DOOR APPARATUS

[76] Inventor: Elmer A. McRoy, 916 Miami, Leavenworth, Kans. 66048

[21] Appl. No.: 869,169

[22] Filed: Jan. 13, 1978

[51] Int. Cl.[2] ..... E05B 17/00

[52] U.S. Cl. ..... 292/346; 70/418

[58] Field of Search ..... 292/346, 304, 340, 281, 292/285, 300, 304; 70/106, 416, 418

[56] References Cited

U.S. PATENT DOCUMENTS

| | | | |
|---|---|---|---|
| D. 34,243 | 3/1901 | Taylor | 292/346 |
| 2,127,891 | 8/1938 | Starling | 292/346 |
| 3,290,081 | 12/1966 | Sushan | 292/346 |
| 3,377,094 | 4/1968 | Thompson | 292/346 |
| 3,392,999 | 7/1968 | Thompson | 292/346 |
| 3,405,962 | 10/1968 | Sushan | 292/346 |
| 3,963,269 | 6/1976 | Rosenberg | 292/304 X |
| 3,976,318 | 8/1976 | Krus | 70/418 X |
| 4,010,968 | 3/1977 | Rehfeld | 292/346 |

*Primary Examiner*—J. Franklin Foss

*Attorney, Agent, or Firm*—Schmidt, Johnson, Hovey & Williams

[57] ABSTRACT

Burglary-resistant apparatus for denying access to door locks through a door crevice is adapted for mounting on a doorjamb adjacent one or more door locks and comprises a vertically elongate blocking plate disposed over the crevice between the doorjamb and a door, which includes flat surface portions extending over marginal portions of the door and substantially into a groove within the doorjamb thereby making it especially difficult to gain access to the crevice by circumventing the blocking plate. A vertically elongate locking plate has one vertical edge thereof secured to the blocking plate and extends perpendicularly therefrom to form a rigid structural unit having a generally T-shaped cross section. The locking plate is adapted to be secured to the doorjamb adjacent the door crevice and cooperates with the edge of the blocking plate seated within the groove of the doorjamb to provide particularly rigid mounting of the blocking plate to prevent dislodgement of the latter even under the influence of burglary tools.

4 Claims, 4 Drawing Figures

BURGLARY RESISTANT DOOR APPARATUS

BACKGROUND AND BRIEF DESCRIPTION OF THE INVENTION

This invention generally deals with burglary resistant lock apparatus for conventional building-type doors and relates more particularly to a unique structure for denying unauthorized access to door lock means through the crevice between a door and its associated doorframe.

Unauthorized entry through locked doors is often accomplished by defeating the door's lock mechanism in any of a number of manners known by skilled intruders and burglars. Less sophisicated lock mechanisms may be defeated by introducing a thin rigid plate, such as a credit card, into the crevice between the door and its frame adjacent the lock mechanism to gain physical access to the latter. Even the most sturdy of the deadbolt type locks may be quickly disabled by wedging a pry-bar into the door crevice adjacent the lock and then prying the door and lock away from the doorframe. Although some door mounting structural configurations include a stop member secured to the door frame which functions to limit the movement of the door to one side of the doorframe opening and also incidentally covers the door crevice, this stop member is often not an integral part of the door frame itself and may be easily pryed away, with burglary tools, to expose the door crevice. Doors mounted within doorframes having wooden doorjambs are particularly vulnerable to the unauthorized entry approach as mentioned above since the wooden frame structure yields easily under the leverage imposed through heavy metal pry-bars or the like. Consequently, there is a need in the art for a effective means of blocking the door crevice in a manner to insure that access to the door lock is denied and which may not be circumvented even through the use of burglary tools, but yet which does not interfere with the normal use of the door.

According to the present invention, a burglary resistant apparatus is adapted to be mounted on a doorjamb adjacent a door lock and comprises a first vertically elongate blocking plate, disposed over the crevice between the doorjamb and the door, which extends over marginal portions of the door as well as into a vertically extending groove within the interior of the doorjamb. A vertically elongate flange-like locking plate has one vertical edge thereof secured to the blocking plate and extends perpendicularly from the latter to form a rigid structural unit having a generally T-shaped cross section. The locking plate is secured to the doorjamb and cooperates with the edge of the blocking plate seated within the doorjamb groove to provide especially rigid mounting of the blocking plate in order to prevent dislodgement of the latter under the influence of burglary tools.

An important object of the invention is to provide burglary resistant apparatus which includes a stationary blocking plate covering the crevice between a door and its associated doorjamb and secured to the latter adjacent a door lock in order to deny unauthorized access to the door lock through the crevice.

Another object of the invention is to provide a blocking plate of the mentioned type which overlaps marginal portions of the door and extends into the interior of the doorjamb itself whereby to present a continuous flat surface area extending laterally a substantial distance on each side of the crevice in order to prevent the introduction of a pry-bar or the like into the door crevice amd to also resist penetration of burglary apparatus into the door or into the doorjamb adjacent to the door lock.

A further object of the present invention is to provide burglary resistant apparatus of the type mentioned that includes a flange-like member secured to the blocking plate which provides a means for securing the apparatus adjacent the door crevice in order to prevent unauthorized removal of the apparatus from the doorjamb for the purpose of gaining access to the door crevice and the door lock.

A still further object of the invention is to provide burglary resistant apparatus of the type described in which the flange-like member cooperates with the portion of the blocking plate which is disposed within the interior of the doorjamb in a manner to provide especially rigid mounting of the apparatus on the doorframe and thereby fortify the door lock mechanism to discourage intruders from tampering with the latter in an effort to gain unauthorized opening of the door.

Another object of the invention is to provide a flange-like member of the mentioned type which provides a locking plate for receiving a door lock element therethrough, while also providing a means of rigidly mounting the blocking plate on the doorjamb.

Other and further objects of the invention will be made clear or become apparent in the course of the following description of a preferred embodiment of the invention.

DETAILED DESCRIPTION OF THE INVENTION

Figure 1:
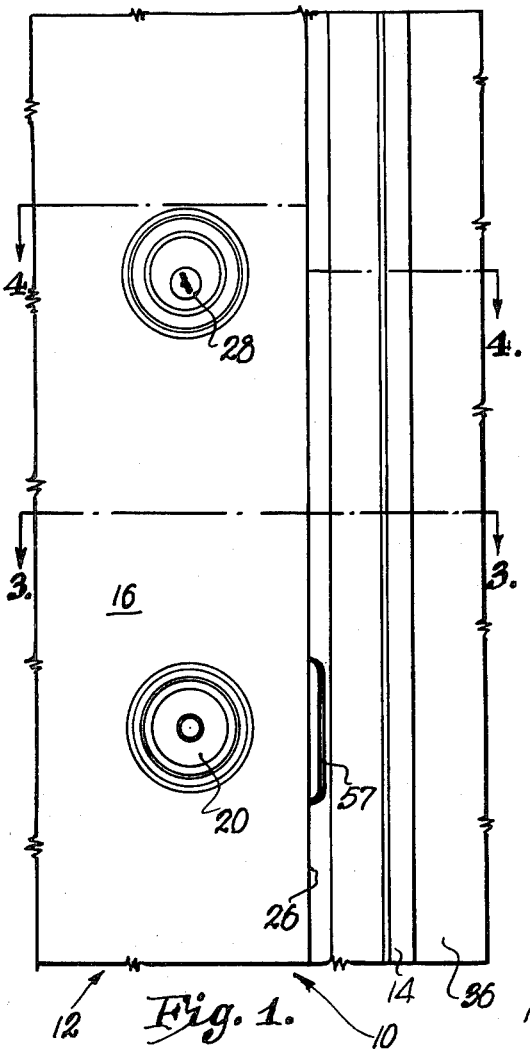
FIG. 1 is a fragmentary side view of a portion of an ordinary building door and its associated doorframe taken from a position inside the door opening, and showing the door in a closed position with burglary resistant door apparatus, which forms the preferred embodiment of the invention, installed therewith.
Figure 2:
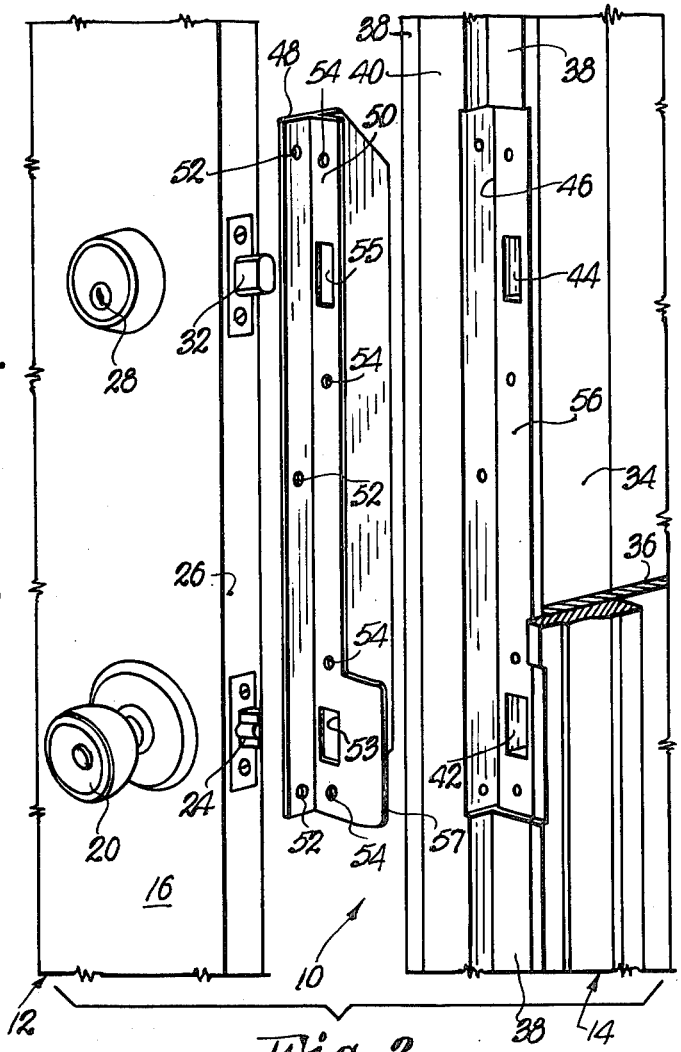
FIG. 2 is a fragmentary, exploded perspective view from inside the door opening showing the relationship between the door, the burglary resistant door apparatus, and the doorjamb.

Turning now to the drawing, burglary resistant door apparatus broadly designated by the numeral 10 is adapted to be installed between the ordinary building door 12 and its associated doorframe 14. The door 12 includes an interior face 16 adjacent one side of the opening defined by the doorframe 14 which may be considered for purposes of the present description to be the "interior side" of the door while the exterior face 18 of the door 12 is adjacent the other side, or "exterior side" of the opening. The door 12 has a pair of locking means associated therewith including a lower twistable knob lockset comprising an inner knob 20, and outer knob 22 and mechanism operably coupled therewith (not shown) inside the door for shifting the associated bolt member 24 through an opening in the door edge 26, which edge is generally perpendicular to the door faces 16 and 18. The lower lockset is the known type that allows the door bolt 24 to be locked in place by the selective manipulation of inner knob 20 so that the outer knob 22 is ineffective to operate the door bolt 24. A second locking means comprises an upper key operated, cylinder-type lock mechanism which is provided with inner and outer key receptacles 28 and 30 respectively, and a shiftable door bolt 32 operable in response to manipulation of the internal mechanism (not shown) associated therewith by a valid key device.

For purposes of the present description it may be assumed that the door 12 is hingedly mounted in the common manner for horizontal swinging movement about a vertical axis adjacent the door edge (not shown) opposite the door edge 26, although it is understood that other door mounting approaches may be successfully employed in connection with the present invention. The doorframe 14 may assume any of various known structural configurations and is herein shown as being formed by a number of wooden structural components, including: a vertical stud member 34 having wall forming elements 36 joined on opposite ends thereof; a vertically elongate face plate 38 joined to stud member 34 on one side of the latter adjacent to the door opening; and, a stop strip 40 secured on one side of the face plate 38 adjacent the door opening. Normally, when the door 12 is in a closed position, the door edge 26 is disposed generally parallel to the face plate 38 and is slightly spaced from the latter to form a crevice or gap therebetween, one flat surface of the stop strip 40 being adapted to engage marginal portions of the door 12 in order to maintain the latter in a closed position within the opening, and prevent the same from swinging toward the outside area of the door opening. The face plate 38 is provided with a pair of vertically spaced notched areas 42 and 44 to receive the door bolts 24 and 32 respectively therewithin, and is further provided with a vertically extending groove 46 therein, generally aligned in a vertical plane which includes the exterior surface face 18 of door 12 when the latter is in a closed position, the groove 46 also extending laterally away from the door opening into the stud member 34. The face plate 38, along with stud member 34, comprise what is generally referred to by those skilled in the art as a doorjamb.

The door protective apparatus 10 is adapted to be secured to the doorjamb and, as will become readily apparent hereinunder, provides a simple but particularly effective means of preventing a credit card, pry-bar or the like from being wedged into the door crevice adjacent either of the door bolts 24 or 32. The protective apparatus 10 comprises an essentially flat blocking plate 48, and a generally flat locking plate 50 having one edge thereof joined to central stretches of the blocking plate 48 to form a structure having a generally T-shaped cross-section. The plates 48 and 50, which are vertically elongate, are each preferably formed from any hardened metal which is resistant to bending and may be joined together as by welding to form a rigid structural unit. Blocking plate 48 may include a plurality of vertically spaced holes 52 therethrough along the interior edge thereof to allow securement of the same with screws or the like (not shown) to stop strip 40. Similarly, locking plate 50 possesses a plurality of vertically spaced holes 54 therethrough to allow securement of the same with screws (not shown) to the face plate 38. Locking plate 50 also includes a pair of vertically spaced openings 53 and 55 therein respectively aligned for registration with notches 42 and 44 to allow passage of the corresponding door bolts 24 and 32 therethrough, and may be further provided with a slightly arcuate depending portion 57 adjacent opening 53 which functions, in conjunction with the surface areas of locking plate 50 surrounding opening 53, as an ordinary striker plate for the door bolt member 24. From the foregoing then, it can be appreciated that the invention provides a unique combination of structural features which not only protectively cover the door crevice and incorporate a lock striker plate therewith, but also novelly employ the mounting of the locking plate 50 in combination with the mounting of the blocking plate 48 to yield a burglary resistant apparatus which is especially difficult to dislodge. It is to be noted that although the door apparatus 10 is shown herein as being used in combination with the pair of vertically spaced lock means, the invention may be easily adpated, and is entirely suitable for use with a single lock means.

The door apparatus 10 may be installed in the door frame simply by inserting one vertical edge of the blocking plate 48 into the groove 46, positioning the locking plate 50 into abutment with the face plate 38, and then screwing the plates 48 and 50 into the stop strip 40 and face plate 38 respectively. In some installations, it may be necessary to provide a recess 56 in the face plate 38 within which the locking plate 50 may be seated.

Figure 3:
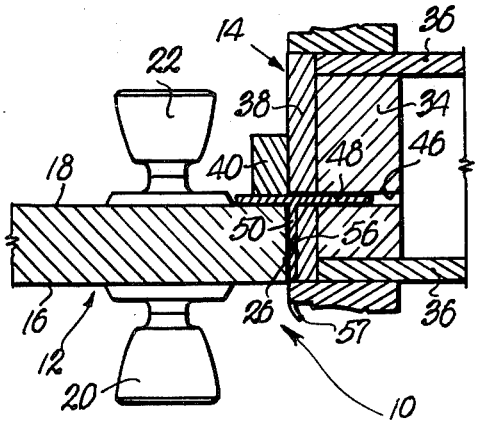
FIG. 3 is a cross-sectional view taken along the line 3—3 of FIG. 1.
Figure 4:
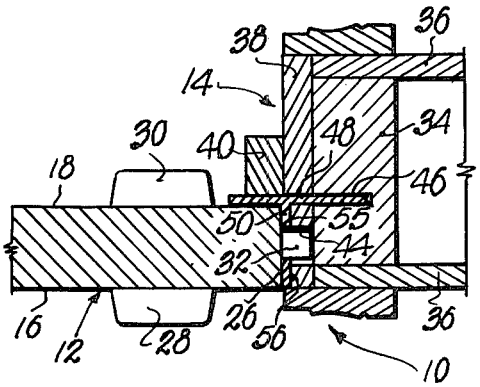
FIG. 4 is a cross-sectional view taken along the line 4—4 of FIG. 1.

As best shown in FIGS. 3 and 4, with the door apparatus 10 in its installed position, the blocking plate 48 has central vertical portions thereof overlapping and covering the door crevice, one vertical edge of the blocking plate 48 overlapping marginal portions of the door 12 and interposed between the latter and the stop strip 40, while the opposite vertical edge thereof extends into the groove 46 in the face plate 38 and the stud member 34. It is important to note here that the blocking plate 48 presents a flat surface 58 of substantial lateral dimension to the area outside the door 12; by this feature of the invention it becomes extremely difficult, if not impossible, to wedge a pry-bar into the door crevice by attempting to penetrate the face plate 38 in order to introduce the end of a pry-bar behind the vertical edge of the blocking plate 48 seated within the groove 46. Thus, an intruder using a pry-bar is forced in his attempts to circumvent the blocking plate 48 to resort to wedging the end of the pry-bar between the vertical edge of the blocking plate 48 which overlaps the marginal portions of the door 12 and the door 12 itself. The intruder's success in eventually gaining access to the door crevice in this manner will depend, of course, on various incidental factors such the hardness and therefore the bendability of the blocking plate 48, the penetrability of the marginal portions of the door 12, and the extent to which the vertical edge of the blocking plate 48 overlaps the door 12. In any event, as a further significant feature of the present invention, it becomes exceedingly difficult for the intruder to dislodge the door apparatus 10 out of the door crevice and away from the doorframe 14 by prying away the vertical edge blocking plate 48 which overlaps marginal portions of the door 12, since the door apparatus 10 is secured not only by means of the locking plate 50 to the face plate 38, but is further secured by the vertical edge of the blocking plate 48 which is seated within the groove 46; thus, it is apparent that the vertical edge of the blocking plate 48 seated within the groove 46 cooperates with the locking plate 50 to secure the door apparatus 10 in its operative position in a manner which virtually precludes the possibility of its removal by an intruder attempting to gain access to the door crevice from the area outside the door opening.

From the foregoing, it is clear that the invention provides especially effective means for denying access to door lock mechanisms through door crevices, but yet which is especially simple in structure and easily installed on a doorframe. Thus, it will be observed that my burglary resistant door apparatus not only provides for the reliable accomplishment of the objects of the invention, but does so in a particularly simple and economical manner. It is recognized, of course, that those skilled in the art may make various modifications or additions to the preferred embodiment chosen to illustrate the invention without departing from the gist and essence of my contribution to the art. Accordingly, it is to be understood that the protection sought and to be afforded hereby should be deemed to extend to the subject matter claimed and all equivalents thereof fairly within the scope of the invention.

I claim:

1. A burglary-resisting improvement for door apparatus of the kind comprising frame means defining a door receiving opening between an interior space and an exterior space, said frame means having jamb structure presenting an uprightly extending surface including an inner uprightly extending portion, an outer uprightly extending area and an intermediate uprightly extending zone between said portion and said area, said inner portion of said jamb surface having a cavity formed therein adapted for receiving a bolt member, inwardly openable door means mounted on said frame means for movement to and from a closed position within said opening, said door means having an interior face, an exterior face and an uprightly extending edge configured to be disposed in facing but spaced gap-presenting relationship to said inner portion of said jamb surface when said door means is in said closed position thereof, lockable latching means carried by said door means and including a shiftable bolt member movable between a retracted position thereof and an extended position thereof protruding from said edge of said door means sufficiently for reception of a distal part of said bolt member within said cavity formed in said inner portion of said jamb surface, and stop strip means uprightly extending along said outer area of said jamb surface and mounted on said jamb structure in manner vulnerable to relatively easy loosening or separation of said strip means from said jamb structure through the use of ordinary burglary tools, said burglary-resisting improvement comprising, in combination:

an elongate, upright groove formed in said jamb structure and extending into the latter along a part of said intermediate zone of said jamb surface reaching above and below the level of said cavity;

an elongate, unitary, rigid, metal blocking plate assembly of T-shaped transverse cross-section, said cross-sectionally T-shaped assembly including a locking plate portion and a pair of flange portions laterally extending in opposite directions substantially perpendicularly from one lateral edge of said locking plate portion, said lock plate portion being provided with an opening therein adapted for alignment with said cavity, said assembly being disposed with said locking plate portion engaging and extending uprightly along a part of said inner portion of said jamb surface reaching above and below the level of said cavity, said locking plate portion extending laterally between said part of said inner portion of said jamb surface and a facing part of said edge of said door means when the latter is closed to substantially fill the gap therebetween, said opening being aligned with said cavity, one of said flange portions laterally extending into said groove and longitudinally reaching above and below the level of said cavity, the other of said flange portions extending laterally and longitudinally between an interiorly facing part of said strip means reaching above and below the level of said cavity and a facing part of the exterior face of said door means when the latter is closed;

means for rigidly securing said locking plate portion to said jamb structure along the part of said portion of said jamb surface facing said edge of said door means when the latter is closed; and means for rigidly securing said other flange portion to said interiorly facing part of said strip means, whereby, when said door means is closed, said one flange portion deters access from said exterior space to the distal part of said bolt member through said jamb structure with a pry bar or the like, said strip means and said other flange portion normally deter access from said exterior space to said bolt member with a credit card or the like, said other flange portion deters access from said exterior space to said bolt member with a credit card or the like even when said strip means has been loosened from said jamb structure by a pry bar or the like, and said strip means secured to said other flange portion deters effective bending of said other flange portion away from said exterior face of said door means with a pry bar or the like employed from such exterior space, by virtue of the disposition of said strip means between said jamb surface and said other flange portion, when an attempt is made to bend the latter away from said exterior face of said door means in order to gain access to said bolt member.

2. The improvement of claim 1, wherein:

each of said locking plate portion and said one flange portion is of lateral width substantially as great as the distance between said faces of said door means.

3. The improvement of claim 2, wherein:

said other flange portion is of lateral width greater than the corresponding dimension of said strip means and extends beyond the latter in overlapping relationship to said part of said exterior face of said door means when the latter is in its closed position.

4. The improvement of claim 3, wherein:

said locking plate portion is provided with an integral striker plate extension upon the other lateral edge thereof extending into said interior space and reaching above and below the level of said cavity.

* * * * *